US006419538B1

(12) United States Patent
Diaz

(10) Patent No.: US 6,419,538 B1
(45) Date of Patent: Jul. 16, 2002

(54) MARINE PROPULSION SYSTEM AND METHOD USING AN IN-SITU GENERATED WATER PLASMA

(75) Inventor: Rodolfo Enrique Diaz, Phoenix, AZ (US)

(73) Assignee: Arizona Board of Regents, Tempe, AZ (US)

( * ) Notice: Subject to any disclaimer, the term of this patent is extended or adjusted under 35 U.S.C. 154(b) by 0 days.

(21) Appl. No.: 09/436,836

(22) Filed: Nov. 9, 1999

Related U.S. Application Data

(60) Provisional application No. 60/107,922, filed on Nov. 10, 1998.

(51) Int. Cl.[7] ..... B63H 19/00; H05H 1/00
(52) U.S. Cl. ..... 440/113; 60/202
(58) Field of Search ..... 440/6, 113; 60/202; 310/11

(56) References Cited

U.S. PATENT DOCUMENTS 3,191,092 A * 6/1965 Baker et al. ..... 315/111.61
3,279,175 A 10/1966 Hendel et al.
3,322,374 A 5/1967 King, Jr.
3,669,056 A * 6/1972 Wurmbrand et al. ..... 440/6
3,678,306 A 7/1972 Garnier et al.
3,771,313 A * 11/1973 Kaiho ..... 60/216
4,754,601 A * 7/1988 Minovitch ..... 60/204
4,891,600 A * 1/1990 Cox ..... 315/501
4,906,877 A * 3/1990 Ciaio ..... 310/11
5,211,006 A * 5/1993 Sohnly ..... 60/202
5,267,883 A 12/1993 Gudmundsen
5,270,515 A * 12/1993 Long ..... 219/687
5,334,060 A * 8/1994 Butka ..... 440/6
5,435,761 A * 7/1995 Shimamune et al. ..... 440/6
5,439,191 A * 8/1995 Nichols et al. ..... 244/169
5,598,700 A 2/1997 Varshay et al.
5,668,420 A * 9/1997 Lin et al. ..... 310/11
5,675,306 A 10/1997 Diaz
5,956,938 A * 8/1999 Brandenburg ..... 60/203.1

* cited by examiner

*Primary Examiner*—S. Joseph Morano
*Assistant Examiner*—Andrew D. Wright
(74) *Attorney, Agent, or Firm*—Baker Botts L.L.P.

(57) ABSTRACT

A system for marine propulsion includes a metal fuel slurry, a water plasma, and a high alternating magnetic field. The magnetic field acts on the metal fuel to generate explosive momentum via a metal-water reaction. The reaction may also generate the water plasma. The magnetic field then acts on the water plasma using induction magnetohydrodynamic ("MHD") pumping to generate MHD momentum. The explosive and MHD momenta propel the water through a water channel. The water may be used to propel marine vessels or to pump water.

31 Claims, 2 Drawing Sheets

MARINE PROPULSION SYSTEM AND METHOD USING AN IN-SITU GENERATED WATER PLASMA

This application claims the benefit of U.S. Provisional Application Serial No. 60/107,922, filed Nov. 10, 1998.

BACKGROUND OF THE INVENTION

The present invention relates to highly efficient marine propulsion systems, which are not based on conventional water-screw technology. In particular, the present invention relates to using magnetohydrodynamic technology for propulsion in marine vessels.

Due to the cavitation limits of water-screw (i.e., propeller) technology, highly efficient propulsion mechanisms which are not based on water-screw technology are needed to maximize the speed of marine vessels (i.e., vessels that are propelled in the water and under the surface of water, for example, boats, submarines, torpedoes, or underwater missiles). Three technologies, magnetohydrodynamic ("MHD") propulsion, the analog of airborne rocket propulsion, and ram-jet technology, have been proposed for this purpose. All three technologies offer the potential for exceeding the speed of conventional propeller-based vessels. These technologies are not subject to the cavitation limits of water-screw technology and they minimize the number of moving parts in contact with the water stream.

The latter two technologies are mechanical propulsion systems. A simple ("low-tech") version of the first, jet propulsion, is described in U.S. Pat. No. 5,267,883 to Gudmundsen, issued Dec. 7, 1993, as not involving the mechanical compression of water containers. This technology is appropriate for surface marine vehicles because it uses a cyclic vacuum pump to draw water from the environment and then expel it like a jet. An example of the second system, ram-jet technology, described in U.S. Pat. No. 5,598,700 to Varshay et al., issued Feb. 4, 1997, involves underwater propulsion by inserting a gaseous jet stream into the water flow to obtain a water ram-jet operation. The gaseous jet stream is assumed to be derived from a separate energy source such as solid rocket fuel.

Although both of these exemplary methods are operable, they are significantly inefficient in converting stored energy into kinetic energy. Gudmundsen's method uses an external energy source to mechanically power a vacuum pumping system which then transforms the pressure differential into kinetic energy of the water stream. Varshay et al.'s system may have fewer moving parts, but the energy still undergoes conversion into a gaseous jet, which suffers significant friction loss at the jet injectors. Furthermore, the efficiency of the ram-jet operation depends on the efficiency of the heat exchange between the gaseous jet and the water. These multiple conversions of energy reduce the final usable kinetic energy.

An alternative to these technologies is MHD propulsion, which uses the natural electrical conductivity of sea water as a power source. The advantages of MHD are quiet operation due to the absence of moving parts, high speed due to the absence of a cavitation limit, and high efficiency due to the nearly direct conversion of electrical energy into kinetic energy. Furthermore, the maximum theoretical efficiencies are relatively well understood. O. M. Phillips's early prediction (in "The Prospects for Magnetohydrodynamic Ship Propulsion," *Journal of Ship Research*, pp. 43–51 (March 1962)) that top speeds on the order of 10 knots would be the limit for 600-foot vessels, was finally met with the 1992 commercial launch of the *Yamato-I*, a 30 m, 280 ton catamaran. In addition, D. Choi et al. (in "Application of Scalar Implicit Approximate Factorization for Underwater Magnetohydrodynamic Propulsion Concept Analyses," *AIAA Journal*, Vol. 31, No. 2, pp. 286–293 (Feburary 1993)) have continued to refine the computational methods needed to increase the accuracy of the models.

The performance of the conventional MHD approach is limited, however, in several ways. Phillips assumed a maximum magnetic field of 0.6 Tesla and achieved 8% efficiency. R. A. Doraugh (in "Magnetohydrodynamic Ship Propulsion Using Superconducting Magnets," *Transactions of the Society of Naval Architects & Marine Engineering*, Vol. 71, pp. 370–386 (1963)) predicted an increase in efficiency to as high as 60% using a 10 Tesla magnetic field and a speed of 10 knots. In order to maintain high thrust, however, such systems use a thrust increase mechanism, which increases the DC current. This, in turn, increases the amount of power wasted in the form of heat (i.e., through $I^2R$), and, as a result, the highest theoretical efficiencies can never be achieved. Furthermore, these systems use high static magnetic fields, which require the use of cryogenically cooled superconducting coils, with all their attendant logistical and maintenance costs, as the Yamato-I experienced while using magnetic fields on the order of only 4 Tesla.

Thus, conventional marine propulsion systems, both mechanical and MHD, are all limited. Clearly, a need exists for a marine propulsion system which (i) is not limited by cavitation, (ii) has a high stored energy to kinetic energy conversion efficiency, (iii) has a small number of moving parts, and (iv) is inexpensive to maintain.

SUMMARY OF THE INVENTION

In accordance with the present invention, a method and a system of propelling water are described. The method for propelling water includes generating a water plasma, generating a magnetohydrodynamic ("MHD") momentum in the water using th e water plasma, and propelling the water using the MD momentum. Preferably, the MHD momentum is generated by subjecting the water plasma to a high alternating magnetic field. Preferably, the MHD momentum is generated using induction MHD pumping.

The met hod preferably generates an explosive momentum in the water, which is also used to propel the water. The explosive momentum is preferably generated by a metal-water reaction, and the reaction is preferably generated using a high alternating magnetic field. The high alternating magnetic field is preferably generated by amplifying a conventional alternating magnetic field. In the metal-water reaction, the water reacts with bare liquid metal particles in the presence of high energy. The high energy may come from heat and/or arcing between the metal particles ("parts-to-particle arcing"). The arcing may be caused by subjecting the metal particles to the high alternating magnetic field. The bare liquid metal particles are formed by adding heat to solid metal particles in the presence of particle-to-particle arcing. When cold, the metal particles are coated with oxide. The arcing breaks down the oxide coating and allows the heat generated inside the particles to catalyze the metal-water reaction. The heat is generated as a result of eddy currents flowing inside the solid metal particles. These eddy currents are, in turn, induced by the high alternating magnetic field.

In a preferred embodiment, the number of energy conversions is reduced when the water plasma is generated by the metal-water reaction. In this way, the water plasma is generated using high current pulse discharges in conjunction with the reaction.

The method preferably uses sea water, but may also use fresh water. The method may be used to propel a marine vessel or to pump the water, for instance to circulate the water in a cooling system.

The system for propelling water includes a metal fuel, a water plasma, and a high alternating magnetic field that acts on the metal fuel to generate explosive momentum and that acts on the water plasma to generate MHD momentum, and the explosive and MHD momenta propel the water. Preferably, the water plasma is generated by the high alternating magnetic field acting on the metal fuel. Preferably, the MHD momentum is generated using induction pumping. The metal fuel preferably comprises a slurry made of metal particles and the water. The metal particles can be made of aluminum, titanium, copper, or nickel. The high alternating magnetic field can be generated using a magnetic step-up transformer that amplifies a conventional magnetic field.

The present invention provides various technical advantages. One technical advantage is that it provides a marine propulsion system which minimizes the number of moving parts. Another technical advantage is its minimization of the use of energy, which is accomplished in a number of ways. First, wasted heat energy is minimized by reducing the resistance (R) of the sea water through the in-situ creation of water plasma. Second, the marine propulsion system efficiently converts stored energy into kinetic energy without using conventional water-screw technology. Third, the invention takes advantage of efficient induction MHD pumping. Fourth, the invention reuses energy produced in other steps. For example, the water plasma used in MHD pumping is generated by the metal-water explosion; some of the heat used to trigger the metal-water explosion comes from particle-to-particle arcing which also serves to break down the oxide coatings on the metal particles; and eddy currents induced by the high alternating magnetic field create heat to melt the metal particles while still in their oxide coatings, and also are used to trigger the metal-water explosion. The synergy of the various processes minimizes the number of energy conversions and maximizes the simplicity of the system. The benefits of the present invention are (a) compactness, because the propulsion system is self-sustaining and includes a moderate radio frequency electrical power source (which could be replenishable through the metal-water reaction's excess energy), metal fuel, and an alternating magnetic field amplifier, in a suitable sea water channel; (b) higher energy conversion efficiencies than can be attained by practical superconducting MHD thrusters; and (c) MHD operation without electrodes and their associated electrolytic damage.

BRIEF DESCRIPTION OF THE DRAWINGS

For a more complete understanding of the present invention and the advantages thereof, reference is now made to the following detailed description taken in conjunction with the accompanying drawings, wherein like reference numerals represent like parts or components, in which.

DETAILED DESCRIPTION OF THE INVENTION

The system and method for marine propulsion through water include injecting a metal fuel into the water and generating a high alternating magnetic field to induce eddy currents in the metal fuel. The induced currents catalyze a metal-water explosion which generates a water plasma and explosive momentum. The alternating magnetic field acts on the water plasma and generates MHD momentum. Then, the explosive and MHD momenta propel the water and/or water plasma from a pressure chamber or water channel. This system picks up more water and the system continues operating. The metal fuel includes small particles and is formed as a slurry when the particles are immersed in water. The eddy currents are induced in the small metal particles of the metal slurry and heat the inside of the metal particles. The high alternating magnetic field causes particle-to-particle arcing which further increases the energy in the reaction chamber.

Although MHD systems are quieter than conventional propeller systems, they are not low-noise systems. To that end, conventional dampening technologies known to those skilled in the art (e.g., noise dampening technologies used in internal combustion or a ram-jet arrangement propulsion systems), may be incorporated to reduce the noise generated by the system of the present invention.

Figure 1:
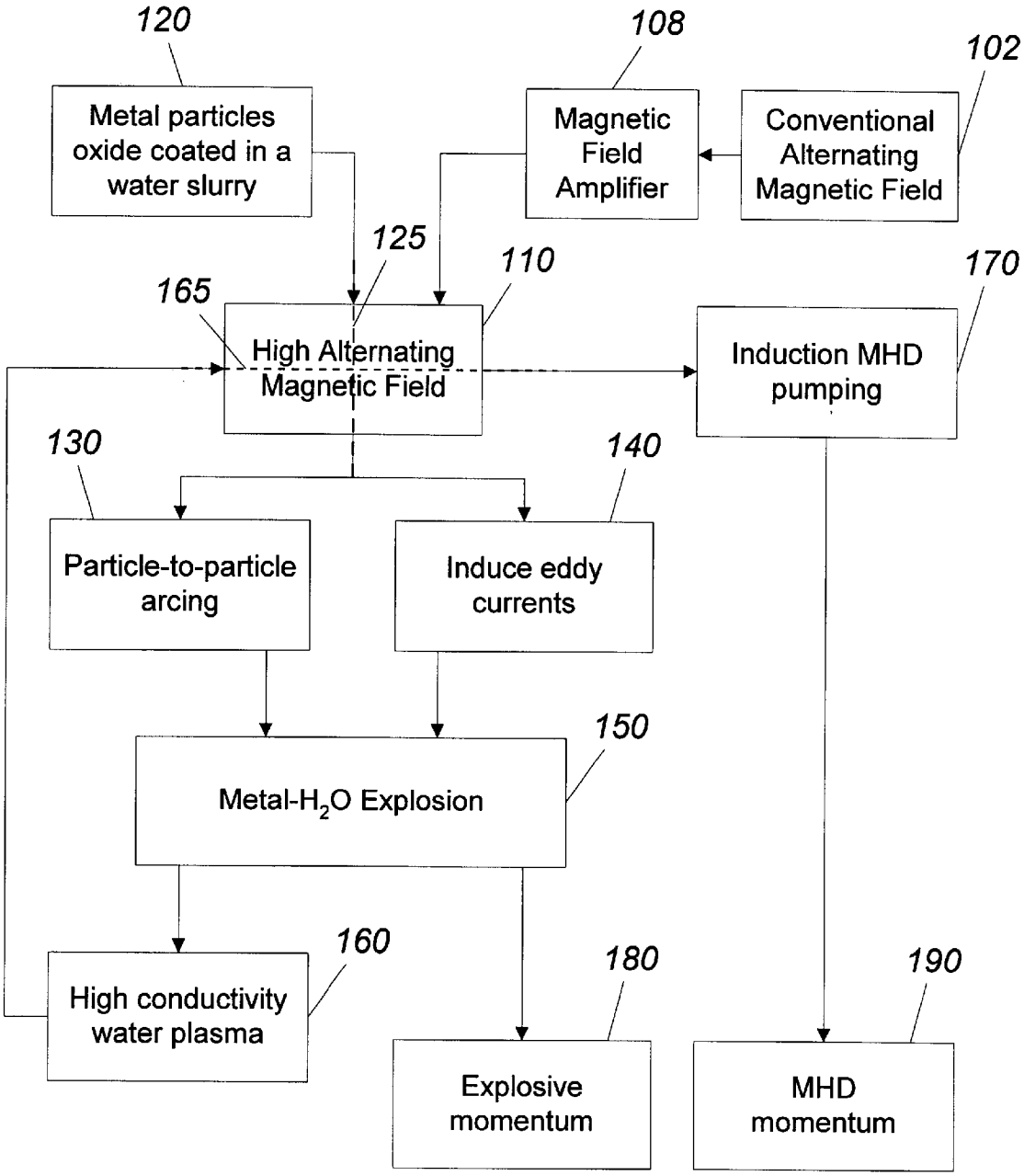
FIG. 1 is a flowchart of a propulsion system according to an embodiment of the present invention.
Figure 2:
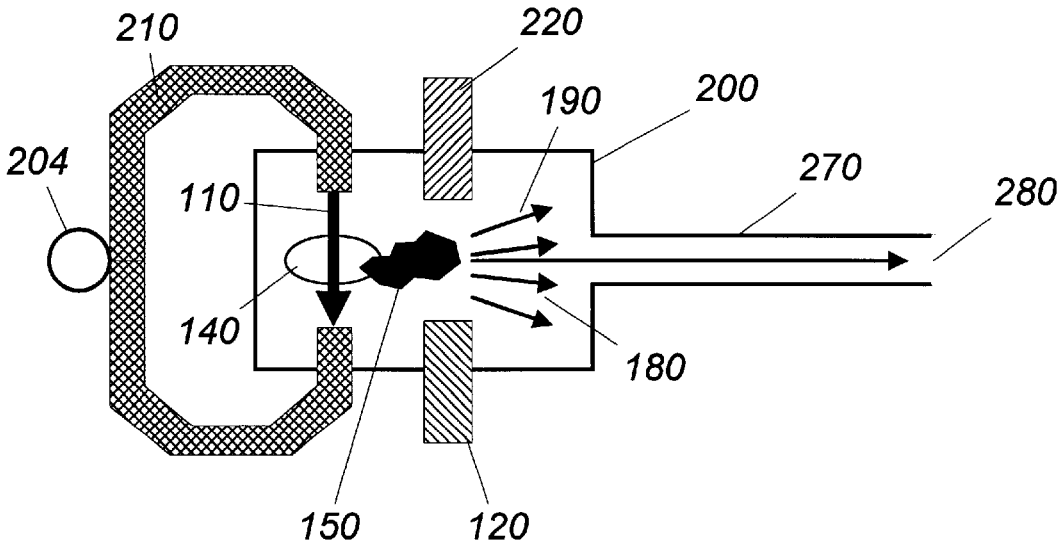
FIG. 2 is a schematic diagram of a propulsion system according to an embodiment of the present invention.
Figure 3:
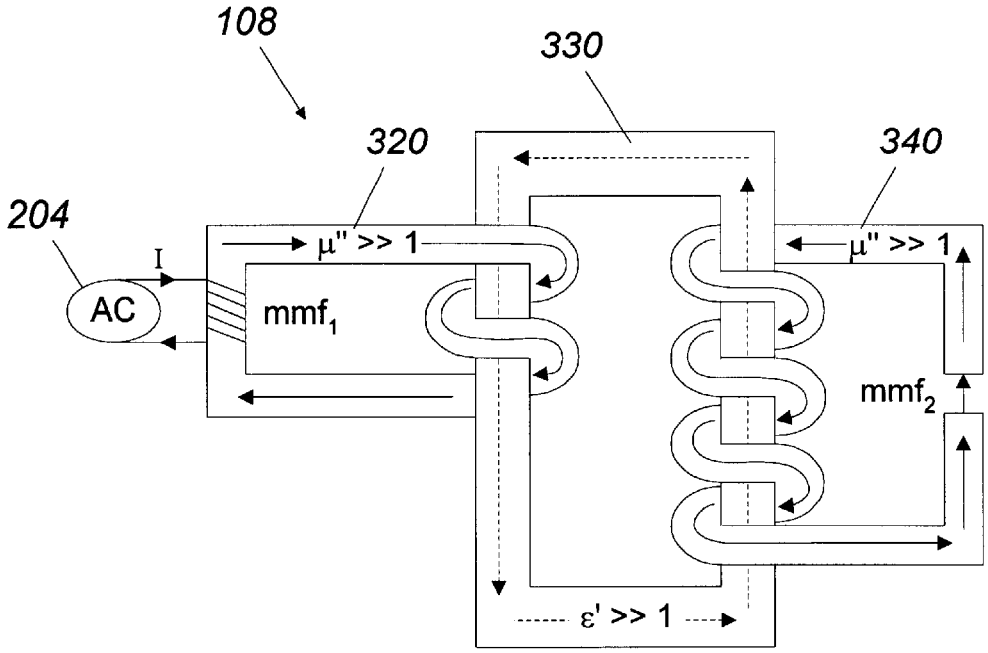
FIG. 3 is a schematic diagram of a prior art alternating magnetic field amplifier circuit used in an embodiment of the present invention.

FIGS. 1 and 2 are, respectively, a flowchart and a schematic diagram of a propulsion system according to an embodiment of the present invention. High alternating magnetic field 110 is created by amplifying a conventional alternating magnetic field 102. In magnetic field amplifier 108, an example of which is shown in FIG. 3, the magnetomotive force (mmf) of the primary ($mmf_1$), produced by AC source 204, is amplified two times (based on the turns ratio of the secondary to the primary) to produce an $mmf_2 = 2*mmf_1$. (FIG. 3 is derived from U.S. Pat. No. 5,675,306 to Diaz, issued Oct. 7, 1997, the disclosure of which is incorporated herein by reference.) The motive power therefore increases four times. One of the elements of this amplification is the magnetic material used in the magnetic conductors 320, 340. This magnetic material has a very high imaginary part $\mu''$ of the permeability. In addition, the dielectric core 330 has a very high real part $\epsilon'$ of the permittivity. Such a dielectric core 330 can be made from ceramics, ferroelectrics, or artificial materials having a high dielectric constant. In FIG. 2, magnetic circuit 210 and AC source 204 schematically produce high alternating magnetic field 110. In the preferred embodiment of the present invention, the amplifier circuit amplifies the conventional magnetic field by at least a factor of 4, and preferably by a factor of between 4 and 10.

Once a high alternating magnetic field is operable, metal fuel slurry 120 is injected into chamber 200, which can be a pressure chamber. Chamber 200 contains water due to water injection 220, which can be injected at any time prior to the reaction process. Metal fuel slurry 120 is made of a mixture of high surface area metal particles and water. A variety of metals can be used to react exothermically with water. Suitable metals for use in the present invention include, but are not limited to, aluminum, titanium, copper, and nickel. At room temperature, the particles are coated with a naturally formed oxide, which makes the slurry pre-mixture a relatively safe fuel to store. For an aluminum slurry, the particles may have mean diameters from about 1 $\mu$m to about 40 $\mu$m. The aluminum particles are pre-dispersed in a high density slurry at a volume density from about 30% to about 70%, preferably from about 40% to about 70%, and more preferably about 63% of the metal particles. The higher practical density limit is dictated by the morphology and size distribution of the particles (e.g., the percentage volume of particles in a mono-dispersed solution of spheres can be affected by physical and chemical limitations) and also by the desire to have a "flowable" pre-mixture that is capable of being rapidly delivered to the chamber or water channel. The lower density limit is determined according to two limitations: (i) the desire to have a compact fuel supply (e.g., in a predispersion slurry) and (ii) the fact that about 30% volume fraction is the approximate stoichiometric ratio of aluminum to water that would support a complete reaction, as will be described later. The use of small spherical particles is a reasonable trade-off between the requirements for "flowability" of the slurry and the desire to have a large surface area available for the reaction. Flakes or other rough surface forms of the metal may also be used, but the delivery system will have to take into account the higher viscosity and thixotropy (e.g., shear dependent viscosity) of the slurry.

High alternating magnetic field 110 acts on the metal particles, as illustrated by dashed line 125 in FIG. 1. In one embodiment, high alternating magnetic field 110 preferably has an operating frequency between 10 kHz and 100 MHz. Higher frequencies result in shallower electrical skin depths in the metal particles (i.e., the depth within the particle or particulate to which a magnetic field penetrates), which in turn causes more heat to be generated in the particles for activation of the later metal-water reaction. The operating frequency can be tailored to the specific performance and material needs of each particular system.

One of the results of this interaction between high alternating magnetic field 110 and metal fuel slurry 120 is the induction of eddy currents 140 in the metal particles. These eddy currents rapidly heat up the metal, causing them to melt within their oxide coatings. Another result of the interaction between high alternating magnetic field 110 and metal slurry 120 is arcing 130 between and among the metal particles ("particle-to-particle arcing"). As particle-to-particle arcing 130 increases, the oxide coating begin to break down, allowing the hot metal liquid to react with the water. The combination of the energy from particle-to-particle arcing 130 and the heat from induced eddy currents 140 catalyzes the metal-water reaction/explosion 150.

Metal-water explosion 150 is highly exothermic. For an input triggering energy caused by particle-to-particle arcing 130 (or other type of electrical, pulsed current discharges) of from 3 kJ to 10 kJ per gram of metal, the output energy is on the order of 15 kJ per gram of metal. In a system using aluminum slurry, the main reaction is represented by the following chemical reaction:

$$2Al+3H_2O \rightarrow Al_2O_3+3H_2$$

The stoichiometric balance of this reaction requires approximately 54 grams of aluminum to 54 grams of water, a one to one mass ratio, which translates to an approximate 1:3 volume ratio of metal to water. In a well dispersed mixture, such as would result from injection of the pre-dispersion slurry into a free sea water stream, every aluminum particle will have access to the minimum amount of water required (at least three times its volume) to react completely. As a result, the pre-dispersion slurry can be injected into the sea water stream at any injection rate so long as the 1:3 volume ratio of metal to water is not exceeded in the sea water channel (i.e., there should not be too much metal particulate which could remain unreacted). The rate at which the electrically triggered metal-water reaction proceeds consumes about 15% of the aluminum in the first 40 $\mu$s to 100 $\mu$s. At this rate, for a fluid flow in the channel of about 20 knots (~10 m/s), the metal particles are completely reacted in less than 1 cm of travel. Although the fluid flow in the sea water channel may involve localized speeds exceeding this average flow, this number serves to illustrate that the energy triggering region may be conveniently localized to a well defined area inside the water channel.

Metal-water explosion 150 produces two phenomena. The first phenomenon is an explosive momentum or overpressure 180, which properly channeled can propel the water from chamber 200 through water channel 270 to water outlet 280, as shown in FIG. 2. The second phenomenon is the conversion of the water to a water plasma 160.

In water plasma, the conductivity suddenly grows from about 5 mhos/m to about 50,000 mhos/m within about 3 $\mu$s. (An explanation of the plasma characteristics of water is given in V. N. Tsurkin et al., "Plasma Characteristics of a Discharge in Water," *High Temperature* (translation of *Teplofizika Vysokikh Temperatur*), Vol. 25, No. 2, pp. 160–165 (March 1987), the disclosure of which is incorporated herein by reference.) High alternating magnetic field 110 acts on water plasma 160, as illustrated by dashed line 165 in FIG. 1. By a process called induction MHD pumping 170, water plasma 160 exerts a momentum or overpressure 190 to propel the water and water plasma through water channel 270. Without the high conductivity of the water plasma, high alternating magnetic field 110 would still exert a motive force (magnetic pressure) on the water by inducing eddy currents in the water because of its natural conductivity. (Fresh water, having no conductivity, cannot be pushed at all by MHD methods, absent creation of a plasma.) In such a case, however, this technology wastes too much energy in heating the water. The creation of water plasma 160 increases the conductivity so much that the pressure induced is strong enough to propel the water from chamber 200 through water channel 270.

Induction MHD pumping 170 is a technology that is very efficient when used with high conductivity fluids. In conventional MHD, there are two main propulsion approaches: (i) the DC current and static magnetic field approach and (ii) the open linear induction motor approach. As used in the prior art, the efficiencies of both approaches are ultimately limited by the poor conductivity of sea water. The DC current and static magnetic field approach is limited because of ohmic heat loss, through $I^2R$, where R is the resistance of the sea water. The open linear induction motor approach is limited by the "impedance mismatch" inherent in trying to use a linear induction motor on a low conductivity secondary such as sea water. However, when a water plasma having very high conductivity (much higher than the typical 5 mhos/m of sea water) is created, induction pumping rapidly becomes more efficient than the standard DC-current MHD approach. As a result, electrical energy conversion efficiencies comparable to that of the DC current approach can be obtained with magnetic field strengths on the order of $1/50^{th}$ that needed for the DC current approach. Because in induction (alternating field) systems the induced current is directly proportional to the pumping magnetic field and is not limited by the output of the DC generator, the total force generated is proportional to the square of the magnetic field. Thus, a doubling of the magnetic field produces a quadrupling of the force and, with it, much higher efficiencies. The high conductivity of the water plasma is thus a critical component of the present invention because it enables the exploitation of the efficiency advantages of induction pumping.

At its extreme, induction pumping is exemplified by the levitation and crucibleless melting of metals in high frequency alternating magnetic fields. When the material to be moved is very conductive, the attainable efficiencies with stronger magnetic fields make flux concentrators—even sacrificial ones—desirable.

However, by using induction MHD pumping as described in U.S. Pat. No. 5,675,306 to Diaz, the available magnetic flux produced by a given amount of current is increased without using sacrificial flux concentrators or superconducting coils, thus simplifying the overall marine propulsion system.

Once MHD momentum 190 is created, it propels water plasma 160 through water channel 270 to outlet 280, where the water plasma can cool and revert to water again. As the fluid is expelled from the chamber, new water is drawn into the chamber (by the Venturi effect) and can be used to rekindle the metal-water explosion. Alternatively, a synchronized system of valves can be used to coordinate the outflow with the influx. Thus, the marine propulsion system of the present invention is an energy efficient, continuous system, and operates indefinitely so long as there is an alternating magnetic field, fuel, and water in the system environment.

Although the preferred embodiment of the marine propulsion system is detailed herein, the invention is not limited to this preferred embodiment. Other types of marine propulsion systems may be used, for instance, those that do not reuse energy from one part of the system in another part of the system. This would include systems in which the water plasma is created apart from the metal-water explosion. In addition, the invention can operate using MHD momentum alone (i.e. without using explosive momentum to propel the water).

While several embodiments have been illustrated and described, other variations and alternate embodiments will occur to those skilled in the art without departing from the spirit and scope of this invention, as defined by the appended claims.

I claim:

1. A method for propelling water, the method comprising:

generating a water plasma;

generating a magnetohydrodynamic momentum in the water using the water plasma;

propelling the water using the magnetohydrodynamic momentum; and generating a high alternating magnetic field, wherein the magnetohydrodynamic momentum is generated by subjecting the water plasma to the high alternating magnetic field.

2. The method according to claim 1, wherein the magnetohydrodynamic momentum is generated using induction magnetohydrodynamic pumping.

3. The method according to claim 1, wherein the water is fresh water.

4. The method according to claim 1, wherein the method is used to propel a marine vessel.

5. A method for propelling water, the method comprising:

generating a water plasma;

generating a magnetohydrodynamic momentum in the water using the water plasma;

propelling the water using the magnetohydrodynamic momentum; and using a time-alternating magnetic field to stimulate a chemical reaction, thereby generating an explosive momentum in the water, wherein the water is also propelled using the explosive momentum.

6. The method according to claim 5, wherein the explosive momentum is generated by a metal-water reaction.

7. The method according to claim 5, wherein the method is used to pump water.

8. A method for propelling water, the method comprising:

generating a water plasma;

generating a magnetohydrodynamic momentum in the water using the water plasma;

propelling the water using the magnetohydrodynamic momentum;

generating an explosive momentum in the water, wherein the water is also propelled using the explosive momentum, wherein the explosive momentum is generated by a metal-water reaction; and generating a high alternating magnetic field, wherein the metal-water reaction is generated using the high alternating magnetic field.

9. The method according to claim 8, wherein the high alternating magnetic field is generated by amplifying a conventional alternating magnetic field.

10. The method according to claim 8, wherein the metal-water reaction comprises reacting the water with bare liquid metal particles in the presence of high energy.

11. The method according to claim 10, wherein the high energy comprises heat or arcing between the metal particles or both heat and arcing between the metal particles.

12. The method according to claim 11, wherein the arcing between the metal particles comprises subjecting the metal particles to the high alternating magnetic field.

13. The method according to claim 10, wherein the bare liquid metal particles are formed by adding heat to solid metal particles in the presence of arcing between the metal particles.

14. The method according to claim 13, the heat is generated by eddy currents inside the solid metal particles.

15. The method according to claim 14, wherein the eddy currents are induced by the high alternating magnetic field.

16. The method according to claim 13, wherein the arcing between the metal particles comprises subjecting the metal particles to the high alternating magnetic field.

17. The method according to claim 8, wherein the magnetohydrodynamic momentum is generated by subjecting the water plasma to the high alternating magnetic field.

18. The method according to claim 17, wherein the water plasma is generated by the metal-water reaction.

19. The method according to claim 18, wherein the water plasma is generated using high current pulse discharges in conjunction with the metal-water reaction.

20. A method for propulsion through water, the method comprising:

injecting a metal fuel into the water;

generating a high alternating magnetic field to induce eddy currents in the metal fuel;

catalyzing a metal-water reaction using the induced currents, the reaction generating a water plasma and an explosive momentum;

generating a magnetohydrodynamic momentum using the alternating magnetic field acting on the water plasma; and propelling the water using the explosive momentum and the magnetohydrodynamic momentum.

21. The method according to claim 20, wherein the metal fuel includes small particles, and the eddy currents are induced in the small particles.

22. The method according to claim 20, wherein the high alternating magnetic field is generated by amplifying a conventional alternating magnetic field.

23. The method according to claim 20, wherein the catalyzing step comprises generating heat to trigger chemical reactions.

24. The method according to claim 20, wherein the reaction is contained in a pressure chamber or water channel.

25. A system for propelling water, comprising:

a metal fuel;

a water plasma; and a high alternating magnetic field for acting on the metal fuel to generate explosive momentum and for acting on the water plasma to generate a magnetohydrodynamic momentum, wherein the explosive and magnetohydrodynamic momenta propel the water.

26. The system according to claim 25, wherein the water plasma is generated by the high alternating magnetic field acting on the metal fuel.

27. The system according to claim 25, wherein the metal fuel comprises a slurry made of metal particles and additional water.

28. The system according to claim 27, wherein the metal particles comprise aluminum.

29. The system according to claim 27, wherein the metal particles comprise at least one of titanium, copper, and nickel.

30. The system according to claim 25, wherein the high alternating magnetic field is generated using a magnetic step-up transformer.

31. The system according to claim 25, wherein the magnetohydrodynamic momentum is further generated using induction pumping.

* * * * *

UNITED STATES PATENT AND TRADEMARK OFFICE

CERTIFICATE OF CORRECTION

PATENT NO. : 6,419,538 B1
DATED : July 16, 2002
INVENTOR(S) : Diaz

It is certified that error appears in the above-identified patent and that said Letters Patent is hereby corrected as shown below:

Column 2,
Line 5, “Feburary” should read -- February --
Line 37, “th e” should read -- the --
Line 38, “MD” should read -- MHD --
Line 43, “met hod” should read -- method --

Column 8,
Line 39, “the heat” should read -- wherein the heat --

Signed and Sealed this

First Day of July, 2003

JAMES E. ROGAN
*Director of the United States Patent and Trademark Office*